US010786003B2

(12) United States Patent
Wiberg

(10) Patent No.: US 10,786,003 B2
(45) Date of Patent: Sep. 29, 2020

(54) SMOKELESS TOBACCO PRODUCT

(71) Applicant: B-O WIBERG SOLUTIONS AB, Lidingo (SE)

(72) Inventor: Bengt-Olof Wiberg, Lidingö (SE)

(73) Assignee: B-O WIBERG SOLUTIONS AB, Lidingo (SE)

( * ) Notice: Subject to any disclaimer, the term of this patent is extended or adjusted under 35 U.S.C. 154(b) by 419 days.

(21) Appl. No.: 15/255,163

(22) Filed: Sep. 2, 2016

(65) Prior Publication Data

US 2016/0366934 A1 Dec. 22, 2016

Related U.S. Application Data

(63) Continuation of application No. PCT/SE2015/050185, filed on Feb. 18, 2015.

(30) Foreign Application Priority Data

Mar. 3, 2014 (SE) ..... 1450234

(51) Int. Cl.

| | |
|---|---|
| ***A24F 23/00*** | (2006.01) |
| ***A24B 13/00*** | (2006.01) |
| ***A24B 15/00*** | (2006.01) |
| ***A24F 23/02*** | (2006.01) |
| *A24B 15/18* | (2006.01) |

(52) U.S. Cl.
CPC ..... *A24F 23/02* (2013.01); *A24B 13/00* (2013.01); *A24B 15/186* (2013.01)

(58) Field of Classification Search
None
See application file for complete search history.

(56) References Cited

U.S. PATENT DOCUMENTS

| | | | | |
|---|---|---|---|---|
| 307,537 | A | 11/1884 | Foulks | |
| 3,935,318 | A * | 1/1976 | Mihailide | A47J 31/20 426/80 |
| 5,346,734 | A * | 9/1994 | Wydick, Jr. | A24B 13/00 131/271 |
| 6,162,516 | A * | 12/2000 | Derr | A24B 13/00 131/271 |
| 6,319,510 | B1 | 11/2001 | Yates | |
| 7,918,231 | B2 * | 4/2011 | Strickland | A24B 15/18 131/273 |
| 8,029,837 | B2 * | 10/2011 | Gedevanishvili | A23L 27/79 426/112 |
| 8,336,557 | B2 * | 12/2012 | Kumar | A23G 3/48 131/111 |
| 9,538,780 | B1 * | 1/2017 | Deroo | A24B 13/00 |

(Continued)

FOREIGN PATENT DOCUMENTS

WO 97/13419 A2 4/1997

*Primary Examiner* — Linda L Gray
(74) *Attorney, Agent, or Firm* — Gabriela B. Tomescu, Esq.; Bergenstråhle & Partners AB

(57) ABSTRACT

A smokeless tobacco product is provided comprising a quantity of smokeless tobacco and a container to hold said tobacco. The container comprises a first side and a second side, wherein the first side is non-permeable to substances in the smokeless tobacco that may sting or harm the mucosae or gum of a user, and the second side is permeable to said substances in the smokeless tobacco. This product overcomes issues with pain and stinging that are caused by smokeless tobacco products.

9 Claims, 3 Drawing Sheets

(56) References Cited

U.S. PATENT DOCUMENTS

Figure 1:
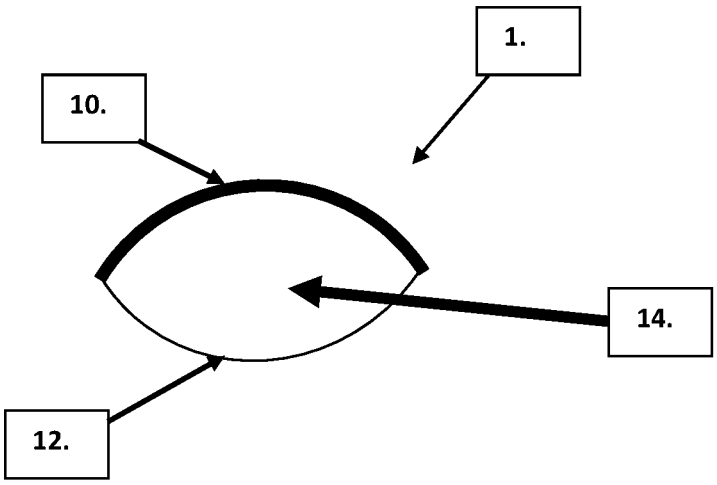

| | | | | |
|---|---|---|---|---|
| 2008/0029110 | A1* | 2/2008 | Dube | A24B 13/00 131/275 |
| 2008/0029116 | A1* | 2/2008 | Robinson | A24B 13/00 131/352 |
| 2008/0081071 | A1 | 4/2008 | Sanghvi et al. | |
| 2009/0025738 | A1* | 1/2009 | Mua | A24B 15/12 131/300 |
| 2009/0038631 | A1 | 2/2009 | Mishra et al. | |
| 2012/0085360 | A1* | 4/2012 | Kawata | A24B 13/00 131/352 |
| 2012/0291794 | A1 | 11/2012 | Kawata et al. | |

* cited by examiner

SMOKELESS TOBACCO PRODUCT

This application is the continuation of International Application No. PCT/SE2015/050185, filed 18 Feb. 2015, which claims the benefit of Swedish patent application SE 1450234-8, filed Mar. 3, 2014, the entire contents of which are hereby incorporated by reference.

TECHNICAL FIELD

The present disclosure relates generally to a smokeless tobacco product, preferably one comprising snus.

BACKGROUND ART

Today there are millions of people who use smokeless tobacco on a daily basis. Using smokeless tobacco is in many ways preferable to smoking tobacco, since it causes less harm to a user and no harm to the people around a user.

Today, a liquid permeable material shaped as a small bag, made from cellulose fiber, is used to package smokeless tobacco products intended to be consumed by keeping them under the lip of a user. The bag is filled with smokeless tobacco. When the saliva of a user passes through the cellulose bag, liquids, salts, flavor enhancers and other substances will be released in all directions through the liquid permeable material.

Virtually all smokeless tobacco products, even when contained in a bag, induce a stinging sensation in the mouth of a user when inserted and used, particularly in the gum and mucosa. This is especially true for new users, but also for experienced users who change the placement of a bag of smokeless tobacco in the mouth. Reasons for changing placement may be because of problems with gum and/or mucosa in the currently used placement. This stinging sensation can be very unpleasant, and it takes time for a user's gum and mucosae to adapt to the juices, salts, acidity regulating substances such as e.g. E500 or E504 and other substances that emanate from a bag of smokeless tobacco. It further takes time to adapt to a foreign object that is kept under the lip. The pain from the stinging can often last for up to half an hour each time a user uses a smokeless tobacco product, until such a time as when the gum and mucosae have grown accustomed to the product as well as the container in which it is packaged.

Another problem with smokeless tobacco, even when packaged in a container, is that it can cause damage to a user's mucosae and gum, which in turn can lead to, for instance, gingivitis, periodontitis and snus lesions, the latter is a common word for changes related to smokeless tobacco e.g. snus that affect the mucosae. Other known problems related to the use of smokeless tobacco include loss of teeth, inflammations in the gum, gingival recession as well as that it causes other changes in the gum and/or oral mucosae, all of which are not necessarily documented yet. There has been shown to be a correlation between the amount of smokeless tobacco used and the damage caused, such as that using more smokeless tobacco or using it more often will increase the damage caused.

Most forms of smokeless tobacco products contain common salt, i.e. sodium chloride, as a flavor enhancer. Common salt can be corrosive to mucosae and gum and may cause a stinging sensation.

Another correlation that has been found is that higher pH-values and high nicotine levels in smokeless tobacco products are correlated with more and quicker nicotine absorption than by smokeless tobacco products with low pH-values. Nicotine in smokeless tobacco products with higher pH-values is generally absorbed faster by the central nervous system than nicotine in smokeless tobacco with lower pH-values. The pH-levels in smokeless tobacco are normally regulated with acidity additives like E500.

Flavouring substances such as e.g. menthol and/or other additives can also cause pain from stinging sensations. Direct physical-, chemical- or biological contact between the many substances in smokeless tobacco and the gum and mucosa can cause harm.

Using materials that prevent substances in the smokeless tobacco to negatively affect gum and mucosae is very difficult to do without also negatively impacting the user experience, since materials that block the negative substances also tend to block out the substances that cause the desired effect.

SUMMARY OF THE INVENTION

It would be desirable to improve smokeless tobacco products in such a way that users do not experience any pain or stinging experience when using one. It is also desirable to reduce the amount of damage caused to users of smokeless tobacco products. Furthermore, it would be advantageous to find a way for smokeless tobacco users to enjoy more varied products, i.e. a 2 in 1 integrated product solution. It is an object of this disclosure to address at least some of the issues outlined above. Further, it is an object to provide a smokeless tobacco product comprising a quantity of tobacco and a container.

According to one aspect, a smokeless tobacco product is provided comprising a quantity of smokeless tobacco and a container. The container comprises a first side and a second side. Material on the first side is non-permeable to substances in the smokeless tobacco which may sting or harm the mucosae or gum of a user, while material on the second side is permeable to said substances in the smokeless tobacco. The above product may be used to obtain a smokeless tobacco product that does not cause pain or stinging to a user and also reduces the risk of damage associated with smokeless tobacco product usage. The product also tend to reduce or eliminate the risk of staining, of a user's teeth, from tobacco juice.

According to a second aspect, a smokeless tobacco product is provided comprising at least two quantities of smokeless tobacco or other products. The container has two compartments holding a respective quantity of tobacco, the compartments separated by a dividing wall. The dividing wall is non-permeable to substances in the tobacco and the sides of the container are permeable to said substances. The above product may be used to increase the available choices of products and also to provide more varied smokeless tobacco products that decrease the need for users to change them regularly.

According to a third aspect, a method for manufacturing a smokeless tobacco product is provided. A container having a first and second side is provided and a quantity of smokeless tobacco is provided as well as placed inside the container. The sides of the container are made from two materials wherein material on the first side is non-permeable to substances in the smokeless tobacco that may sting or harm the mucosae or gum of a user. The material on the second side is permeable to said substances. The above method may be used to obtain a smokeless tobacco product that does not cause pain or stinging to a user and also reduces the risk of damage associated with smokeless tobacco product usage.

The above method and products may also have visual characteristics that distinguish the sides of the container from one another. These characteristics may be for example different colors, patterns or materials.

SHORT DESCRIPTION OF THE DRAWINGS

The invention is now described, by way of example, with reference to the accompanying drawings, in which:

FIG. 1 discloses a first embodiment of the invention comprising one non-permeable side and one permeable side.

Figure 2:
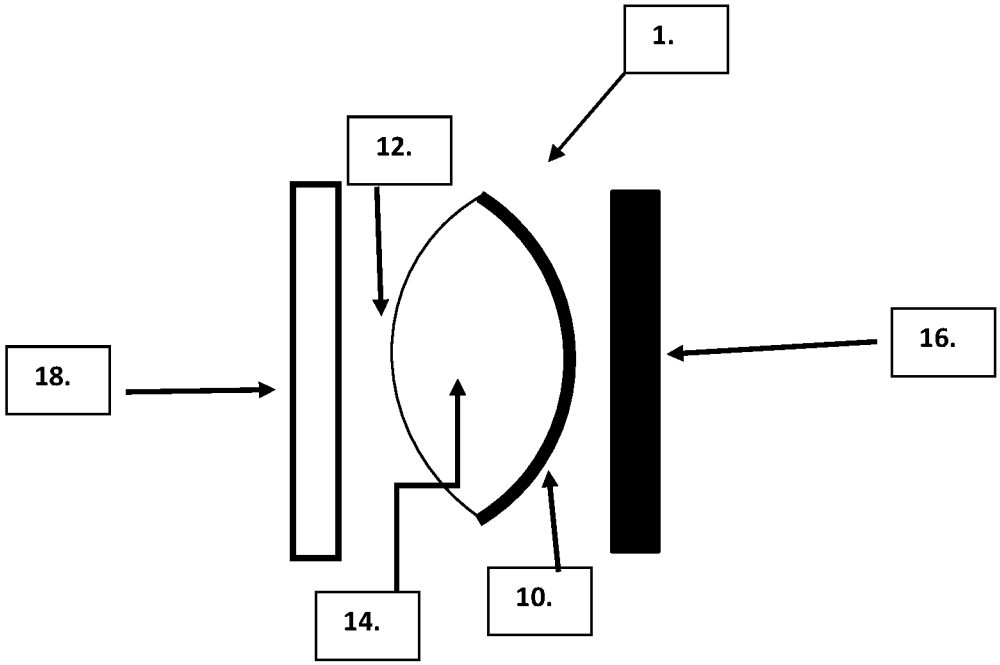

FIG. 2 discloses a schematic view of the first embodiment of the invention, the gum of a user and the inside of a user's lip.

Figure 3:
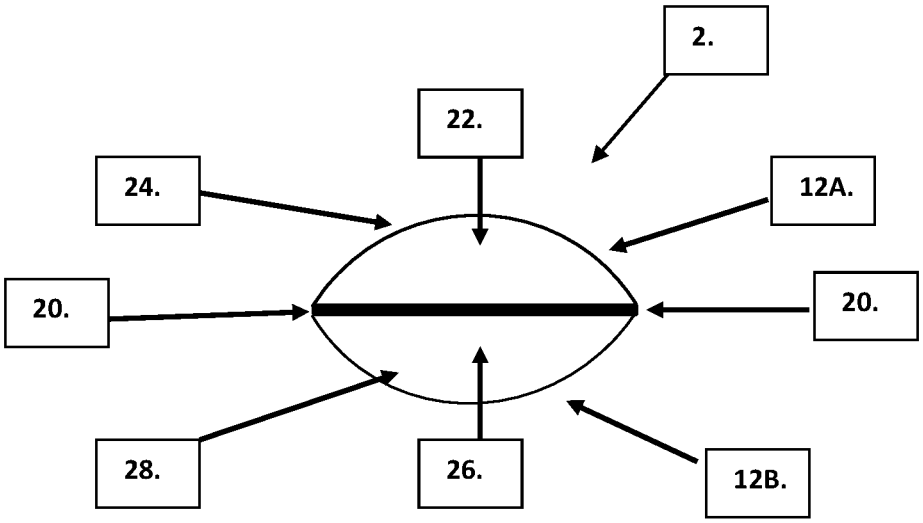

FIG. 3 discloses a second embodiment of the invention comprising one non-permeable dividing wall.

DESCRIPTION OF EMBODIMENTS

In the following, a detailed description of the different embodiments of the invention is disclosed under reference to the accompanying drawings. All examples herein should be seen as part of the general description and are therefore possible to combine in any way in general terms. Individual features of the various embodiments and methods may be combined or exchanged unless such combination or exchange is clearly contradictory to the overall function of the suggested solution.

Throughout this document the term smokeless tobacco is used. Smokeless tobacco is intended to encompass all products containing tobacco that is not smoked, such as snuff and snus, but also equivalents thereof that are used for the same purpose, such as smokeless tobacco substitutes comprising flavored plant parts.

Briefly described, the solution relates to a smokeless tobacco product, preferably comprising snus. The solution comprises a container filled with a quantity of smokeless tobacco and having a first side and a second side, wherein first side is non-permeable to liquids, salts and other substances that may cause harm and/or irritation in the mouth of a user, and the second side is permeable to said substances.

In FIG. 1 a first embodiment of a smokeless tobacco product, generally designated 1, is shown from a front view comprising a first side 10, a second side 12 and a quantity of smokeless tobacco 14. The first side 10 of the container is non-permeable to salts, salt crystals, acidity regulating substances such as E500, and/or other substances that may sting and/or harm the mucosae and gum of a user. The second side 12 is permeable to said substances.

The non-permeable first side 10 can be made of non-permeable materials such as polyethylene, polythene, latex or surgical tape. The first side 10 can also be adapted to be non-permeable through impregnating or treating it with a product that protects the mouth area in which a smokeless tobacco product is placed, such as Orabase®.

Through the first side 10 being non-permeable as described above, a user may feel less or no pain and/or stinging when using a smokeless tobacco product. The pain relief can be complete so that a user does not feel any pain or stinging sensation at all, or it can be partial in that it decreases the negative experience of pain and/or stinging. The pain relief applies especially to new users but also to experienced users that change the area in the mouth where a smokeless tobacco product is applied. Reasons for changing placement may be because of problems and/or irritations with gum and/or mucosa on existing placement or for user's who feel like taking two or more containers of smokeless tobacco in the mouth at the same time whereas at least one container will be placed in a non-normally used existing placement.

In some embodiments, the first side 10 that is non-permeable as described above can have a color that is different from the permeable side 12 in order to facilitate the process of distinguishing between the two. In other embodiments the first side 10 and second side 12 have different patterns associated with them, or are made from materials with easily identifiable differences, such as one side being smooth and the other being coarse. It is also possible for the sides to differ in other ways that are discernible by a user. The non-permeable side 10 can also be covered, invisible for the user, by a membrane of regular permeable cellulose material.

The present solution has solved the problem of providing a smokeless tobacco product that does not cause a stinging sensation and/or pain in the mouth, more specifically the mucosa and/or gum of a user, while still maintaining the desired taste and feel of users. The present solution utilizes the knowledge that nicotine in smokeless tobacco products is absorbed by the inner lip and/or the cheek and oral mucosa, while the pain is experienced primarily in the gum area. Therefore, the permeable side of the herein suggested solution should be facing towards the inner lip in a preferred embodiment. Also, the taste of flavors in smokeless tobacco is mainly detected by taste buds located in the tongue, pharynx and palate. In the present solution taste is preserved by saliva traveling in the mouth and stinging and/or pain is reduced though one side being non-permeable as described above. It has been shown in tests that users using the herein suggested solution experience no pain or stinging sensation. Smell has also been found to be an important part of how a smokeless tobacco product is perceived, and smell is not impacted by the present solution. Users who are particular about their looks tend to avoid using smokeless tobacco since it can stain the visible front teeth beneath the placement of the container of smokeless tobacco. The present solution reduces the risk of staining the teeth since the side facing the gum and teeth has a non-permeable shield which means that the tobacco juice will not flow directly down the user's teeth or even touch the teeth because of the non-permeable barrier.

Other issues related to use of smokeless tobacco such as damage to gum and mucosae in the form of for instance gingival retraction and snus lesions can also be alleviated or fully overcome by using the present solution.

The volume between the first side 10 and second side 12 is filled with a quantity of smokeless tobacco 14. The second side 12 may be made from a material similar to those used in smokeless tobacco products today, which are made from cellulose that is fully permeable to substances in smokeless tobacco as well as to saliva. In some embodiments the second side 12 can be adapted to be non-permeable at some places as long as it is at least partly permeable. This enables production of containers adapted to specific users, which allows substances to pass through a smaller surface area, thus further lessening the amount of substances that pass through into the mouth of a user.

FIG. 2 is a schematic view showing a preferred embodiment of the solution 1 comprising a first side 10, a second side 12 and a quantity of smokeless tobacco 14, and its placement in the mouth of a user in relation to a user's gum and mucosae 16 and the inside of user's cheek and/or lip 18.

Preferably, the side 10 of the container which is non-permeable is placed in contact with a user's gum 16 and the permeable side 12 is placed in contact with a user's inner lip or cheek 18. Pain and/or stinging sensations experienced by a user is mainly associated with the gum and mucosae 16, which is why the non-permeable side preferably should face that direction when placed in the mouth of a user.

FIG. 3 shows a slightly different embodiment of the present solution 2 comprising a container 1 having two permeable sides 12A, 12B and a dividing layer 20, wherein a first volume 22 formed between one of the permeable sides and the dividing wall comprises a first quantity of smokeless tobacco 24, and the other volume 26 formed between the other side and the dividing wall comprises another quantity of smokeless tobacco 28.

Through having a non-permeable layer between the two volumes 22 and 26, it is possible for a user to have a smokeless tobacco product comprising different flavors, moistures, textures, strengths and other variables that can differ between smokeless tobacco products. The non-permeable layer is preferably adapted so that the flavoring substances from one volume 22 may not pass over to the other volume 24. This enables a user to enjoy different aspects of smokeless tobacco products without having to change the container kept in the mouth. This can be especially advantageous for users that regularly have long meetings or other activities in which it can be difficult or embarrassing to change a smokeless tobacco product kept under the lip or simply the wish of the consumer to have a variation in perceived taste or other experience connected with the products i.e. simply for the joy of it. Thus creating a "2 in 1" integrated product solution.

In some embodiments, the products 24, 28 do not have to be smokeless tobacco. It could also be e.g. some kind of sugar free sweets, coffee or any other kind of products that gives the user satisfaction.

To summarize, the present solution helps solve the problem of pain and/or stinging sensation caused by smokeless tobacco products, as well as alleviates or removes common health problems caused by smokeless tobacco, such as gingival retractions and snus lesions. Another embodiment of the solution also solves the problem of users wanting to have different tastes, textures and strengths in environments where it is difficult, embarrassing or maybe even impossible to change a smokeless tobacco product kept under the lip.

While the solution has been described with reference to specific exemplary embodiments, the description is generally only intended to illustrate the inventive concept and should not be taken as limiting the scope of the solution.

The invention claimed is:

1. A smokeless tobacco product, comprising:

(a) a quantity of material consisting of smokeless tobacco and/or plant parts, and (b) a container; said container consisting of a first side made of a first material and a second side made of a second material; wherein said first material is different from said second material; wherein a volume is formed between said first side and said second side, said volume having therein only said quantity of material consisting of smokeless tobacco and/or plant parts; and wherein said first material is non-permeable to substances selected from the group consisting of salt, salt crystals, flavoring and acidity regulating substances of said smokeless tobacco and/or or plant parts and said second material is permeable to said substances.

2. The smokeless tobacco product according to claim 1, wherein said first side is different from said second through one of the following:

(a) said first side has a color that is different from a color of said second side; and/or (b) said first side has an associated pattern that is different from a pattern associated with said second side.

3. The smokeless tobacco product according to claim 1, wherein said first material is selected from the group consisting of polythene and latex.

4. The smokeless tobacco product according to claim 1, wherein said smokeless tobacco is snus.

5. A smokeless tobacco product, comprising:

(a) at least two quantities of smokeless tobacco and/or plant parts, and (b) a container having at least two sides;

wherein said container comprises two compartments, each said compartment containing a respective quantity of said smokeless tobacco and/or plant parts, separated by a dividing wall wherein said dividing wall is non-permeable to substances in said smokeless tobacco and/or plant parts and wherein said at least two sides are permeable to said substances.

6. The smokeless tobacco product according to claim 5, wherein the substances are flavoring substances.

7. The smokeless tobacco product according to claim 5, wherein said dividing wall is made of a material selected from the group consisting of polythene and latex.

8. The smokeless tobacco product according to claim 5, wherein said smokeless tobacco is snus.

9. A method for manufacturing a smokeless tobacco product, comprising the steps of:

(a) providing a quantity of material consisting of smokeless tobacco and/or plant parts, and (b) providing a container, said container consisting of a first side made of a first material and a second side made of a second material; wherein said first material is different from said second material;

wherein a volume is formed between said first side and said second side; and wherein said first material is non-permeable to substances selected from the group consisting of salt, salt crystals, flavoring and acidity regulating substances of said smokeless tobacco and/or plant parts and said second material is permeable to said substances; and (c) placing said quantity of material consisting of smokeless tobacco and/or plant part within said volumel.

* * * * *